United States Patent [19]

Zimmer

[11] 4,157,704

[45] Jun. 12, 1979

[54] FIREPLACE STOVE

[76] Inventor: Ernest C. Zimmer, R.D. #2, Wellsburg, N.Y. 14894

[21] Appl. No.: 832,820

[22] Filed: Sep. 13, 1977

[51] Int. Cl.[2] ..... F24C 1/08

[52] U.S. Cl. ..... 126/62; 126/77; 126/197; 126/202; 292/202; 292/241; 292/340; 126/143

[58] Field of Search ..... 237/51; 126/60-66, 126/120, 121, 202, 197, 140, 298, 77, 285 A, 143; 49/50; 292/202, 204, 240, 241, 340; 220/324

[56] References Cited

U.S. PATENT DOCUMENTS

| | | | |
|---|---|---|---|
| 1,573,194 | 2/1926 | Roe | 49/50 X |
| 2,122,680 | 7/1938 | Dart | 126/197 X |
| 2,355,803 | 8/1944 | Hopewell | 160/37 X |
| 2,703,567 | 3/1955 | Manchester | 126/121 |
| 4,027,649 | 6/1977 | Jackson | 126/62 X |
| 4,061,127 | 12/1977 | Fisher | 126/120 |
| 4,068,649 | 1/1978 | Johnson | 126/120 |

*Primary Examiner*—William F. O'Dea
*Assistant Examiner*—William E. Tapolcai, Jr.
*Attorney, Agent, or Firm*—Shoemaker and Mattare, Ltd.

[57] ABSTRACT

A stove for use in an abode and which includes an air intake system and a viewing door. The air intake system inducts air into the stove from outside the abode and includes a draft control mechanism for controlling the amount of air introduced into the stove. The viewing door includes means for slidably receiving a spark screen, a viewing window and a heat shield, which elements can be used singly or in combination, as desired. A latching mechanism on the door enables the door to be closed with varying degrees of tightness. Alternative embodiments include use of the stove in a water heating system and fans convecting air over the stove outside surfaces.

20 Claims, 10 Drawing Figures

FIREPLACE STOVE

BACKGROUND OF THE INVENTION

The present invention relates in general to stoves, and, more particularly, to heating stoves.

An open fireplace has historically served as a focal point in a room, and, although inefficient, such fireplaces have often been used as a source of heat.

An open fireplace can consume as much as 3000 cubic feet of air per hour. Before the days of insulation, thermopane windows, tight fitting doors, and the like, such air consumption was no problem. However, with the attention to such details now being given by the building industry, free air for a fireplace fire must work its way into the room through light switches, receptacles, and any other small cracks to create a chimney draft. The tighter the house construction, the more difficult this is, and for this reason a roaring fire which will not spill smoke into the room for lack of oxygen is no longer as easily obtainable as it once was.

Wood burning heating devices are old and well-known. A wood burning stove is an example of such well-known devices. However, these devices do not offer a combination of efficient heat production, esthetically pleasing appearances, and compactness so that the device can be used in a fireplace, or the like, of a modern home or other abode, such as a mobile home. Furthermore, these devices may be dangerous if left unattended for long periods of time, as, for example, overnight.

There are many heating stoves and the like presently known. However, none of these devices are easily transformed from units capable of safe, long unattended burning to units suitable for producing a decorative fire used mainly for esthetic purposes, to units suitable for long periods of controlled burning with the associated viewing and minimum attention. Thus, known heating stoves do not have sufficient versatility, efficiency and safety features to meet modern needs.

There are wood burning devices with viewing capabilities, however, the elements used in these devices to close off the viewing window do not effectively seal that opening and, thus, there is danger of a spark escaping and starting a fire in the room containing the device. Furthermore, such devices do not have any capabilities for efficient, clean burning in an abode which has the above-discussed air-tight features.

SUMMARY OF THE INVENTION

The stove embodying the teachings of the present invention efficiently burns in airtight abodes and is capable of versatile operation.

The stove comprises a frame which has defined therein a fire chamber. The stove preferably is used inside a house in a fireplace, or the like, and ambient air is conducted into the fire chamber via a draft intake system which includes an air pipe having one end thereof open to the environment outside of the house or abode and the other end connected to a draft duct in the stove. The draft duct is connected via an air duct to a draft box which opens into the fire chamber, and the air duct is located in heat transfer connection with the fire chamber. Outside air is introduced into the draft duct and is pre-heated while in transit in the air duct to the draft box from heat transferred to the air duct from the fire chamber. A draft control assembly is positioned in the air flow system to control the amount of air inducted in the fire chamber.

A door is hingedly connected to the frame, and includes an latching mechanism which tightly seals the door shut, and can produce several degrees of tightness depending upon the position of the latching mechanism. The secure nature of the latched position of the latching mechanism also ensures that the door will not be accidentally opened. The door has guide rails thereon for slidably receiving a plurality of covering elements which include a spark screen, a transparent viewing window and a heat shield. The covering elements can be used singly or in combination with each other as desired.

The air induction system enables the stove to burn efficiently and cleanly, even in a room which is tightly insulated from the environment. Modern homes, even mobile homes, are very tightly sealed to promote efficient use of energy. Thus, windows, doors, and the like, are well insulated and tightly sealed. A fire uses oxygen at a rapid rate and may become smokey or even be extinguished if it is oxygen-starved. In modern abodes, the fire oxygen requirement must be supplied by air in the room and air must enter the room via light sockets, cracks, or the like, which is not an efficient way of supplying air to the fire. The air intake system used in the stove embodying the teaching of the present invention obviates the necessity of depending upon room leakage or air influx as air is supplied to the stove from outside the abode and is, therefore, available in whatever quantity is necessary. Long burning times, even when the fire is unattended, are, therefore, possible as there is little, or no, danger of the fire becoming oxygen-starved and suffering the problems attendant such a condition.

As a fire in a fireplace is often a focal point in a room, viewing of the fire is quite desirable. Thus, the door of the stove embodying the teaching of the present invention serves to add versatility thereto. The door enables the stove to offer at least three options as to the use of the stove. For example, with just the screen in place, full-open burning is possible which may be esthetically desirable, though inefficient. With the spark screen and viewing window in place, viewing is possible and medium efficient burning is achieved. Lastly, with the spark screen, window, and heat shield all in place, efficient, safe burning is achieved, and the fire can be safely left unattended for long periods, even overnight. Log roll bars are securely mounted on the door and will prevent any logs from rolling out of the fire chamber through the door, thus, further ensuring the safe operation of the stove. The spark screen is furnished with decorative trim and will, thus, encourage use thereof.

OBJECTS OF THE INVENTION

It is, therefore, a main object of the present invention to provide a stove that will burn efficiently in an air tight environment.

It is another object of the present invention to provide a stove which is versatile.

These together with other objects and advantages which will become subsequently apparent reside in the details of construction and operation as more fully hereinafter described and claimed, reference being had to the accompanying drawings forming part hereof, wherein like numerals refer to like parts throughout.

DETAILED DESCRIPTION OF THE PREFERRED EMBODIMENT

Figure 1:
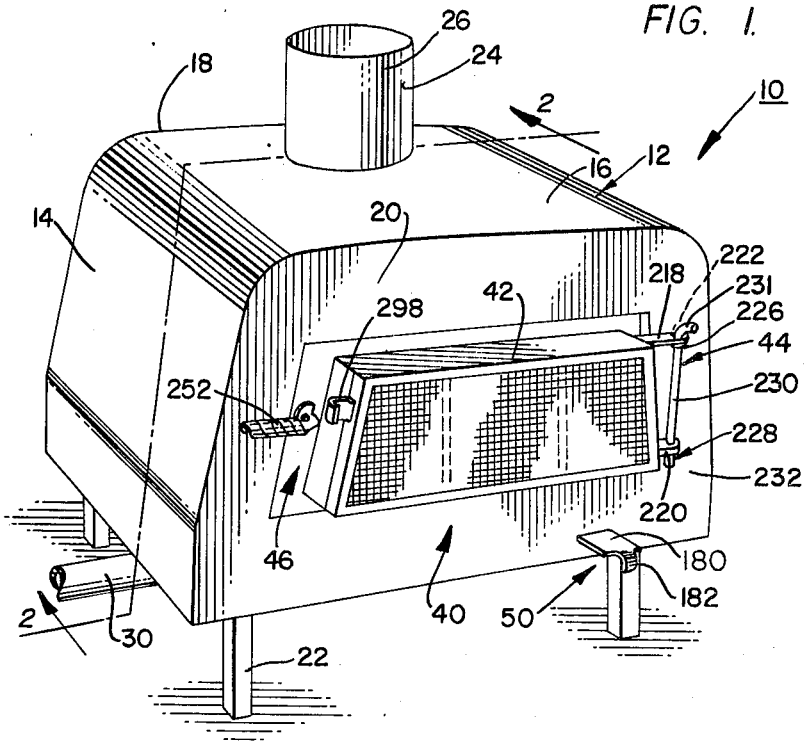
FIG. 1 is a perspective view of the stove embodying the teaching of the present invention.

FIG. 1 is a portable stove 10 which can be used in a fireplace, or the like, of an abode, such as a house, mobile home, or the like. The stove comprises an integral unitary frame 12 having sides 14, top 16, back 18, and front 20. A plurality of legs 22 support the stove and may be rectangularly shaped as shown, or tubular. The legs can also be essentially upright or tilted as desired. A flue thimble 24 is positioned in top 16, near back 18, and approximately centrally of the sides 14. The flue thimble is tubular with a seam 26 and is generally of conventional construction, and the usual chimney or flue is attached thereto in the usual manner. An inlet pipe 30 is connected to the stove and is horizontally oriented therebeneath and conducts ambient air into the stove as will be discussed below. A door assembly 40 is mounted in stove frame front 20 and includes a frame housing 42 mounted on the stove front by a hinge assembly 44 located on one end thereof and has a handle assembly 46 on the other end thereof. The door assembly will be fully discussed below. A draft control assembly 50 is located near the bottom of the stove, and will also be fully discussed below.

Figure 2:
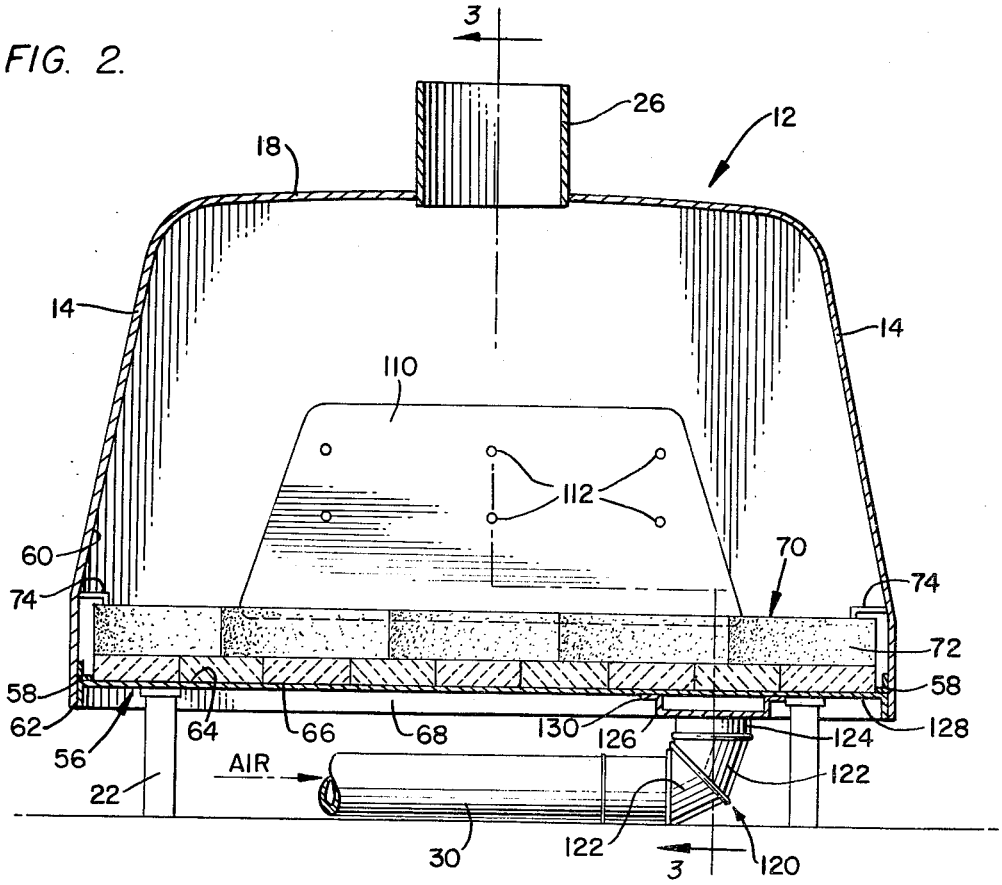
FIG. 2 is a view taken along the plane indicated as 2—2 in FIG. 1.

As shown in FIG. 2, the frame 12 is superincumbent on an understructure, or carriage assembly 56 to which is attached the legs 22. The frame has a plurality of support flanges 58 attached to the inner surface 60 thereof near the bottom perimeter 62 and extend inwardly of the frame. The flanges rest on upper surface 64 of base 66 to support the frame on the carriage, and a lower depending circumferential skirt 68 is, thus, defined to conceal the understructure assembly from view for esthetic purposes. A fire liner assembly 70, which includes a plurality of rows of fire brick 72, is also supported on the base and is held snuggly in position by brick retainers 74 also attached to the inner surface 60 of the frame at a location above the support flanges. Other liners can also be used, and can also be attached to surface 60 of the frame to partially or completely encase that frame in heat resistant material, as necessary, or suitable. Such other liners can be comprised of known materials and attached to the walls and top of the stove in a known manner.

Figure 3:
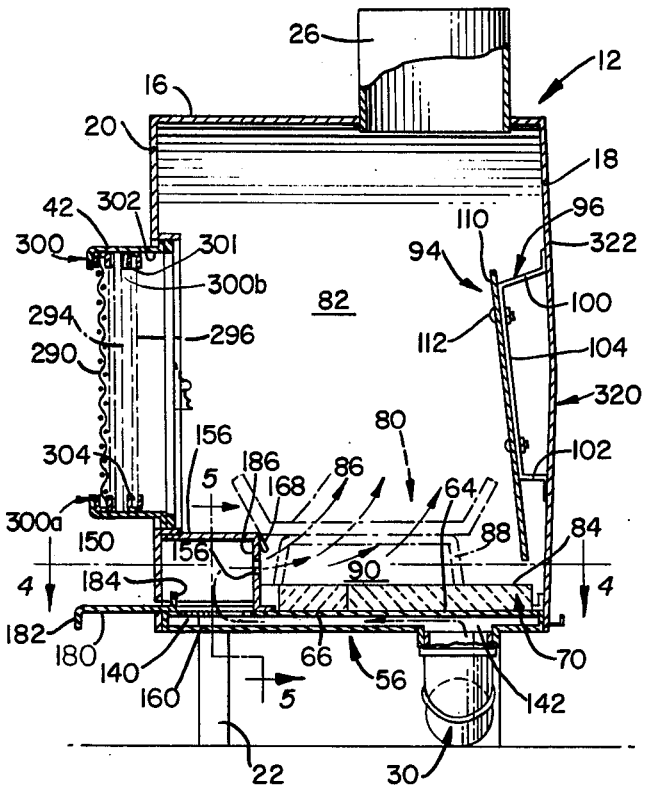
FIG. 3 is a view taken along the plane indicated as 3—3 in FIG. 2.

As shown in FIG. 3, a grate assembly 80 is located in the bottom of fire chamber 82 which is defined by the frame 12 and undercarriage 56. The grate is optional, and when used rests on top surface 84 of the fire liner assembly 70 and has a horizontal log supporting means 86 supported above surface 84 by legs 88 to define a gap 90. The gap 90 can serve as a draft means, as well as an ash pit. A fire shield assembly 94 is mounted on the inner surface of the frame back 18 and includes an integral, unitary bracket 96 with an upper leg 100 and a lower leg 102 connected together by a bight section 104 and each mounted on the back wall 18. As shown in FIG. 3, the legs 100 and 102 are of unequal length so that the bight section is tilted. A fire shield plate 110 is attached to the bracket bight section by a plurality of stove bolts 112 threaded through aligned holes which are defined in the plate and the bracket bight section. The plate is tilted to reflect heat back toward the grate and door assemblies for more efficient use of the heat generated by a fire in the fire chamber, and is located to help hold any fire liner in place, as shown in FIG. 2. The fire shield assembly will also serve to keep the frame back cool enough to abut another surface, such as a fireplace back wall, or the like, without damaging the finish thereof. The back should also be kept cooler than the rest of the stove as portions of the door assembly may be stored thereon, and human contact with the back may occur.

Figure 4:
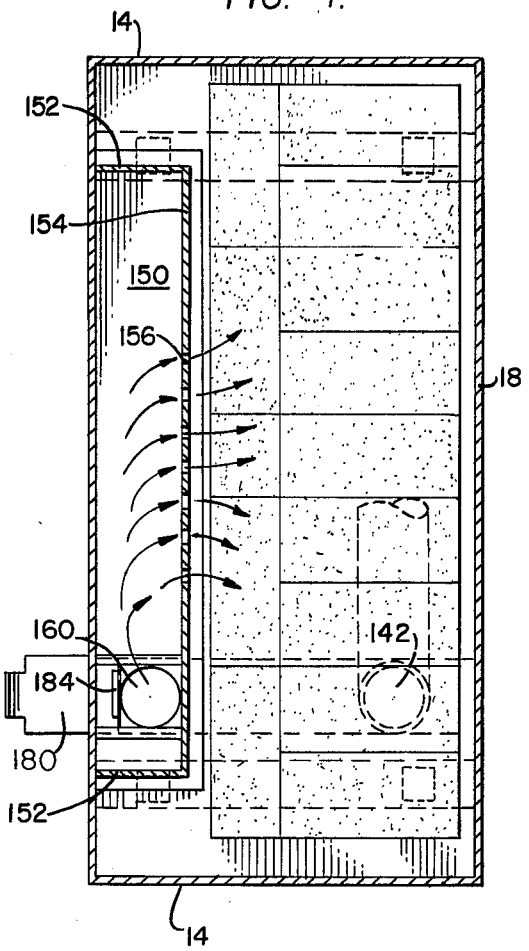
FIG. 4 is a view taken along the plane indicated as 4—4 of FIG. 3.

The draft assembly is best shown in FIGS. 2–5, and attention is directed thereto for a description thereof. As shown in FIG. 2, ambient air is conducted into the stove by inlet pipe 30 which has an outer end (not shown) positioned outside of the abode in which the stove is located to efficiently draw outside air into the stove. Pipe 30 may be tubular and of conventional construction and enters the abode through the floor, wall, roof, or other convenient location or partition. The pipe is connected to the stove by a coupling assembly 120 which comprises a pair of elbows 122 and a draft ring 124 securely mounted on a draft duct 126 which, in turn, is securely mounted on undersurface 128 of the base 66 by flanges 130. The inlet pipe 30 is thus located subjacent the stove and has a riser section formed by the coupling assembly which is located near the back of the stove and closer to one side 14 than the other as best shown in FIG. 4. The draft duct, in turn, is fluidly connected to an elongate air duct 140 which extends from adjacent back 18 to adjacent the front 20 as shown in FIG. 3. The air duct is in heat transfer connection with the fire chamber and, thus, receives heat therefrom to heat the air flowing therein. The air is, thus, preheated prior to introduction thereof into the fire chamber. A port 142 is defined in the air duct to fluidly connect that duct to the draft duct and to conduct air therefrom to the front of the stove.

Figure 5:
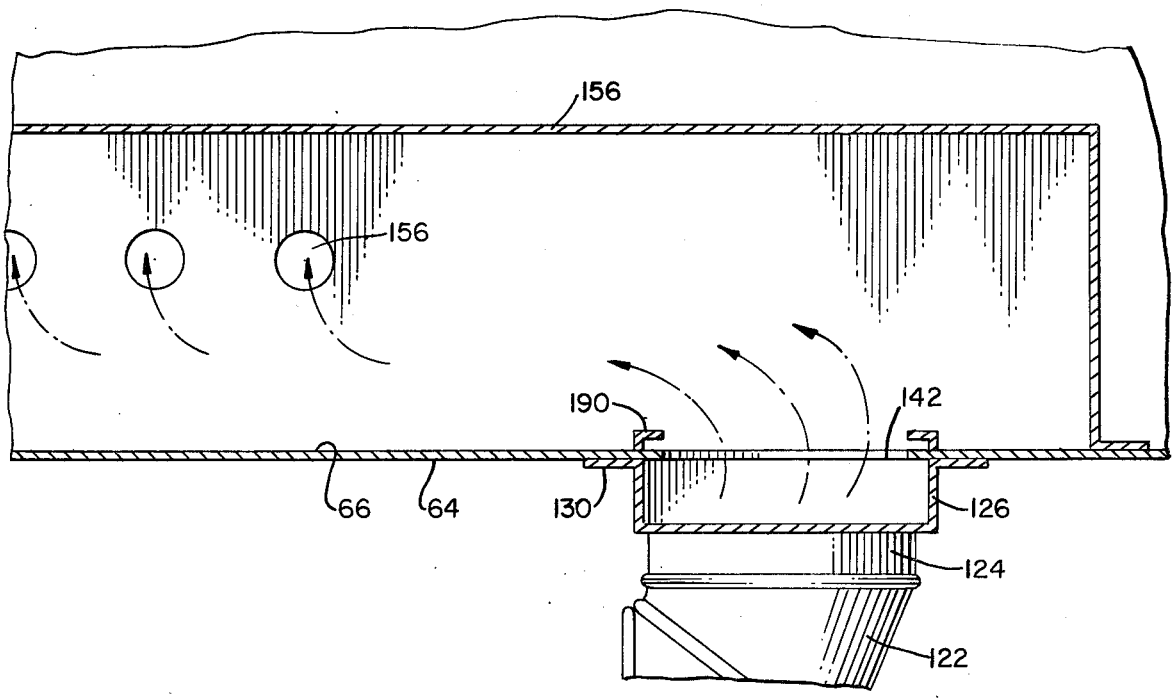
FIG. 5 is a view taken along the plane indicated as 5—5 in FIG. 4.

As best shown in FIG. 3, a draft box 150 is located within the fire chamber 82 at the front thereof and is mounted on the surface 64 of the base 66. The draft box is shown in FIG. 4 to be rectangular and has ends 152 spaced inwardly from sides 14 of the frame 12, a rear wall 154 integrally connecting the ends 152 together, and a top wall 156. The top surface 66 of the base 64 forms the bottom of the draft box so that draft box is a closed container, except as hereafter described. A fore port 160 is located near one end 152 and fluidly connects the air duct 140 to the draft box 150 so that air is conducted therein from the air duct 140. A plurality of spiracles 156 are defined in the rear wall 154 to be horizontally spaced apart and vertically co-elevational as best shown in FIGS. 4 and 5. A draft deflector 168 is attached to rear wall 154 to decline downwardly from near the top wall 156 to a location in front of the spiracles to deflect air flowing into the fire chamber from the draft box via the spircales. As best shown in FIG. 3, the spiracles are located adjacent gap 90 so that air introduced into the fire chamber via the spiracles circulates outwardly from the draft box, upwardly through the gap 90, and thus upwardly through the grate assembly 80 to efficiently aerate the fire fueled by logs, or other fuel, supported on the grate assembly.

Air flow into the fire chamber is, thus, as follows:

ambient air is aspirated into air inlet pipe 30 by the suction created in the fire chamber by the action of the fire;

the air is then conducted into the air duct 140 via the coupling assembly 120 and is pre-heated as it flows from the aft port 142 to the fore port 160 by contact with the base surface;

air is then introduced into the draft box 150 via fore port 160 and then into the fire chamber via spiracles 156. The air thus traverses a tortuous path with the accompanying swirling movements which increase heat transfer thereto, and the aerating and drafting function thereof once introduced into the fire chamber subjacent the fire is indicated by the arrows in FIGS. 3–5.

Positive draft control is exercised using the draft control assembly shown in FIGS. 1, 3, and 4. The draft control assembly comprises a horizontal draft plate 180 slidably mounted on frame 12 by a slot defined near the bottom thereof. The draft plate has a downturned finger grip 182 on the outer end thereof and extends into the stove rearwardly from the slot. The draft plate is best shown in FIG. 3 and is sized and located to cover fore port 160 when fully inserted into the stove. An upstanding abutment flange 184 is positioned on the rear end of the plate to contact inner surface 186 of the draft box rear wall 154. Positive manual control of the draft introduced into the fire chamber is exercised by movement of the draft plate to cover or uncover the fore port 160 and thereby control the amount of air flowing therethrough into the draft box 150. As the draft plate is moved into the frame, the fore port is occluded to interupt air flow into the fire chamber and thereby control the stove by feeding or starving the fire. The fire, of course, will be extinguished completely shortly after the draft plate is fully inserted into the frame to completely cover the fore port 160 and thereby completely shut off air flow into the fire chamber. The stove is relatively air-tight and, thus, the fire will be extinguished quickly after the fore port is blocked. Such action may be important in the event of a flue fire, or the like. Of course, withdrawal of the draft plate from the fore port will intensify air influx into the chamber to thereby feed the fire and increase the heat output thereof.

Draft plate guides 190 are shown in FIG. 5 and include a pair of channel defining L-shaped flanges mounted on top surface 66 of the base in the draft box. The short legs of the L-shaped flanges are directed toward each other and are co-elevational and aligned to define, with the bottom surface 66, a channel to slidably receive the draft plate.

Figure 6:
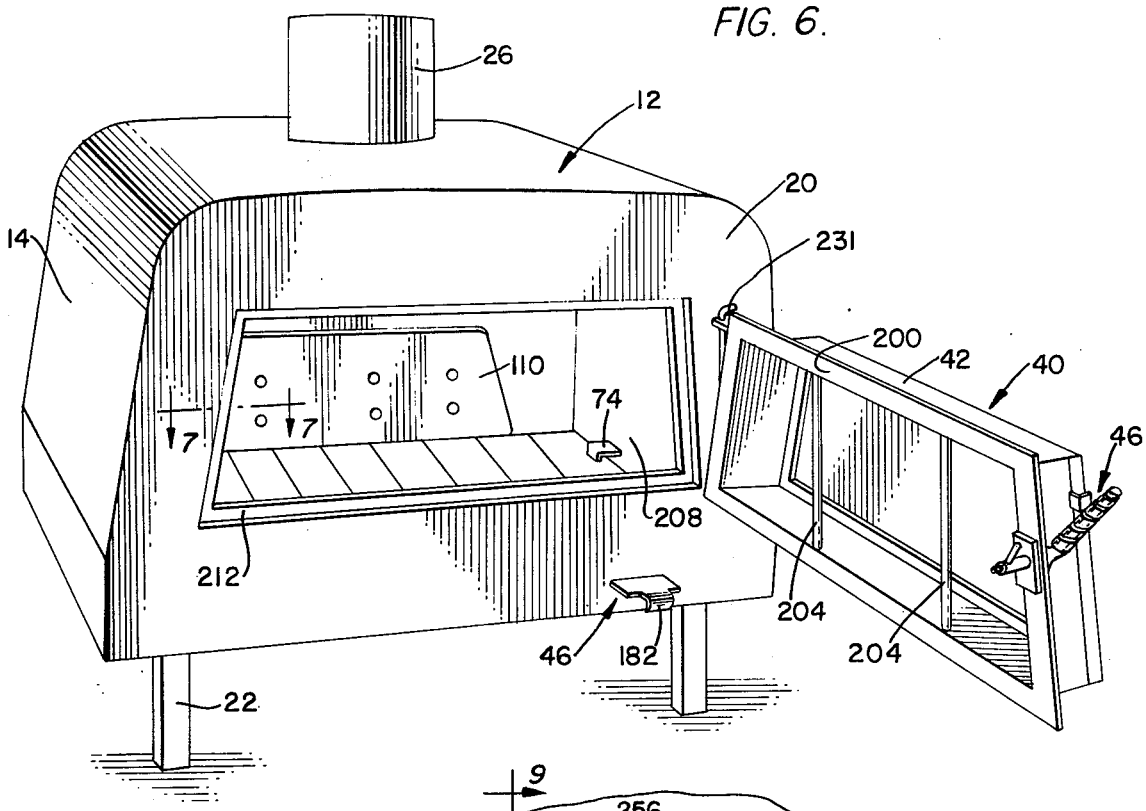
FIG. 6 is a front view of the stove embodying the teaching of the present invention.
Figure 8:
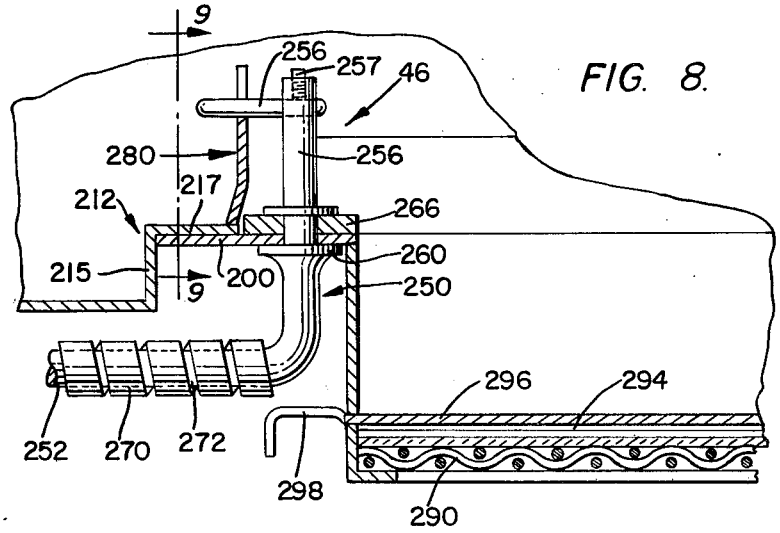
FIG. 8 is a partial view showing the latching mechanism of the stove embodying the teaching of the present invention.

The door assembly 40 is best shown in FIGS. 1 and 6–10 and attention is directed thereto for a description thereof. As best shown in FIG. 6, the door assembly comprises frame housing 42 and a frame border member 200 attached thereto to define the outer perimeter of the door with the handle assembly 46 mounted in the frame 200. The door is trapezoidal in outline, and all of the members thereof are suitably shaped. It is here noted, however, that the door could be shaped in configurations other than trapezoidal without departure from the teachings of the present invention, and the trapezoidal configuration is merely preferred. A plurality of log roll bars 204 are securely mounted in the door to protect that door by intercepting any logs which may roll off of the grate assembly. An access opening 208 is defined in frame front 20 and has a recessed door jamb 212 located thereon about the perimeter thereof. The door jamb is L-shaped as shown in FIG. 8 and includes first and second sections 215 and 217, respectively. The door frame member 200 has one edge located closely adjacent section 217 when the door is closed as shown in FIG. 8. Access to the fire chamber for inserting fuel, removing ashes, or the like, is made through the access opening 208.

The door is mounted on the frame 12 by the hinge assembly to pivot from a closed position to an open position wherein the door is preferably, although not necessarily, open a maximum when it is at right angles to the frame front 20. The hinge assembly includes top and bottom hinge brackets 218 and 220, respectively, which are integrally mounted on the door housing 42. The hinge brackets are preferably L-shaped, but can be other shapes without departing from the teaching of the present invention, and are attached to the frame as by welding or the like. The top hinge bracket has a hole 222 defined therein, and the bottom hinge bracket has a pivot hole defined therein to be vertically aligned with the top hole 222. Top and bottom bracket arms 226 and 228, respectively, are attached to the frame front 20 and each have holes defined therein to be aligned with the holes in the brackets 216 and 218. A hinge pin or bolt 230 has a 90 degree bend 231 thereon and is threaded through the aligned holes to pivotally connect the door brackets to the housing frame brackets and thereby connect the door to the frame in a manner usual to hinges. A cotter pin 232 is inserted through the hinge bolt near the bottom thereof to ensure that the bolt remains secure in the hinge assembly.

Figure 7:
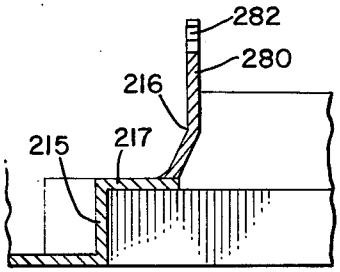
FIG. 7 is a view taken along the plane indicated as 7—7 in FIG. 6.
Figure 9:
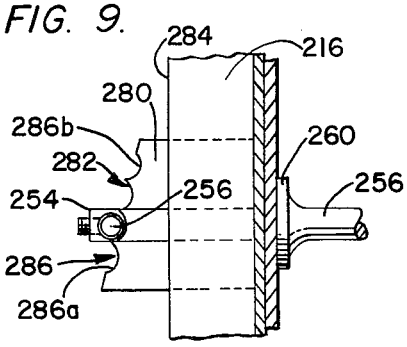
FIG. 9 is a view taken along the plane indicated as 9—9 of FIG. 8.

The door latch mechanism 46 is best shown in FIGS. 7–9 and includes an L-shaped turn bolt 250 with a long leg 252 located exteriorly of the fire chamber and a short leg 254 partially located inside the stove. The short leg 254 is stepped and is rotatably received through the door frame member 200 as shown in FIG. 8. A lock bar 256 is releasably coupled to the short leg by a set screw 257. That portion of the turn bolt located outside of the stove has a diameter which is larger than the diameter of that portion of the turn bolt located inside the stove. A plate 260 serves as a washer abutting the outside of the door frame member, and a washer 262 is located on the inside of the door frame member. The washer is welded, or otherwise securely attached, to the inside of the door frame member 200, and the set screw allows the handle unit to be repaired or replaced. A helical hand grip 270 surrounds the long leg of the turn bolt and is adapted to dissipate heat quickly to remain cool to the touch so the handle can be gripped even when a fire is in the stove. Air spaces 272 between the coils of the helix help to dissipate the heat from the handle hand grip 270. The lock bar is spaced inwardly of the door jamb for a purpose hereafter described. The handle is rotated clockwise to unlock the door, and counterclockwise to lock it.

A latch plate 280 is welded or otherwise securely fastened to the door jamb section 217 as shown in FIGS. 7 and 8. As shown in FIG. 9, the latch plate has a scalloped end 282 located inwardly of the inboard edge 284 of the section 216. The scalloped end 282 is inclined inwardly of the fire chamber from top to bottom and presents a plurality of notches 286 inwardly of the fire chamber. Each of the notches 286 is sized to securely hold the lock bar 256 of the turn bolt as shown in FIG. 9. The inclination of the latch plate causes the door to be secured more tightly when the lock bar is received in bottom notches **286*a* than it is when the lock bar is received in top notches 286*b***. Thus, an air-tight sealed unit can be assured by merely turning the handle more in the counterclockwise direction.

Figure 10:
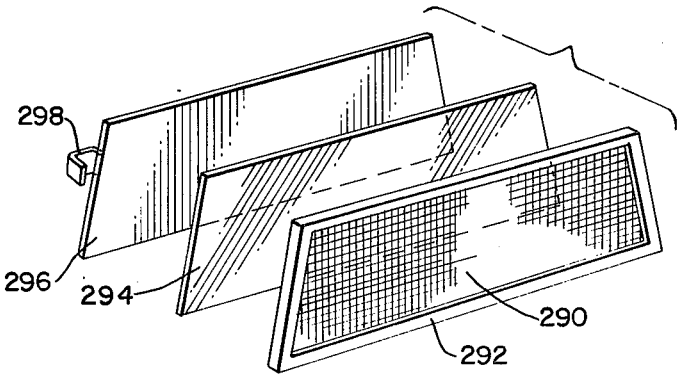
FIG. 10 is a view showing the covering elements of the stove embodying the teaching of the present invention.

As shown in FIG. 10, the door assembly comprises a plurality of covering members, including a foraminous spark screen 290 having a frame 292 surrounding it and which can have trim thereon, a transparent viewing glass plate 294, and a one-piece metal heat shield 296 having an L-shaped handle 298 integral with one edge thereof to extend outwardly therefrom. All of the covering members are trapezoidally shaped to correspond to the trapezoidal shape of the door access opening 208.

As shown in FIG. 3, a plurality of guide rails 300 are mounted on inner surface 302 of the door frame 42 and are positioned so that bottom rails **300*a* are vertically aligned with top rails 300*b* to define vertically aligned channels 304 along facing sides of the frame. The guides are spaced apart horizontally a distance at least larger than the width of the covering members received therein. The covering members are slidably received in the guide channels as shown in FIG. 3. As shown in FIG. 3, the screen 290 and the heat shield 296 are slidable in the channels 304, and the glass plate 294 is slidable between the two channels. Thus, the two channels 304 have opposed flanges 301 which define a channel for slidably receiving the plate 294. Depending upon the situation, one, two, all, or none of the covering elements can be used. Thus, for example, with the spark screen only, full open burning can be achieved; with the spark screen used in combination with the viewing glass, controlled burning can be achieved, and with a combination of the spark screen, the viewing glass and the heat shield, safety for unattended fires is possible. Handle 298 enables the heat shield to be easily inserted and extracted from the door assembly, and the log roll bars protect the glass and screen from logs which may roll off the grate assembly. The roll bars also keep logs from rolling out of the stove when none of the viewing elements are in place and do not disrupt any aesthetic effect produced by the flame when viewed through the door assembly. The log roll bars are attached to the door and will, therefore, remain in place no matter what combination of covering elements is chosen. It is noted that handle 298 need not be heat dissipating as does handle 270 as the heat shield is either stored in back of the unit and thus will not be hot, or will be in place after very long burn times when the fire is out or nearly out (for example, after an overnight burn) and will again not be too hot to touch. However, the handle 298** can be formed with helical coils or the like if desired.

Heat shield mounting brackets 320 are mounted on outer surface 322 of the frame back 18 to accomodate the heat shield 296 when that element is not in use and is to be stored.

The operation of the stove 10 is evident from the above description and will, thus, be presented in summary form only. With the door in the FIG. 6 open position, the desired covering element combination is selected by sliding the covering elements into or out of the door guide channels. Logs, or other suitable fuel, are inserted into the fire chamber through the access opening and placed on the grate assembly, the fire is started, and the door is closed. The handle assembly is turned to set the desired amount of pressure on the door. The draft control assembly is adjusted, and the stove is then in operation. Overnight or unattended operation can be provided when the heat shield 296 is in the door, the fire can be quickly extinguished by completely closing the draft assembly. After use, the stove can be cleaned using the access opening.

In an alternative embodiment of the stove 10, frame 12 is double walled and connected into a hot water system. Water pipes are connected to the stove to circulate water through the double walls to heat that water. The heated water is then conducted, using suitable pumps or the like, into a circulating tank or auxiliary heating unit. The hot water is then used in a hot water baseboard heating system or as a hot water system per se. The stove is used to keep hot water in the hot water system warm so that energy consumption in such a system is reduced.

A further alternative embodiment of the stove includes a fan for convecting room air over the stove exterior surfaces and thereby further utilizes the heat energy produced by the stove as well as maintaining desirable outside surface temperatures of the stove.

As this invention may be embodied in several forms without departing from the spirit or essential characteristics thereof, the present embodiment is, therefore, illustrative and not restrictive, since the scope of the invention is defined by the appended claims rather than by the description preceding them, and all changes that fall within the metes and bounds of the claims or that form their functional as well as conjointly cooperative equivalents are, therefore, intended to be embraced by those claims.

I claim:

1. A fireplace stove for use inside an abode comprising:

a base;

a frame resting on said base, said frame defining with said base a fire chamber and having defined therein an access opening;

an air intake system connected to said base to infuse air into said fire chamber, said air intake system including an air intake pipe opening outside of the abode, and a draft control means on said frame for controlling the amount of air inducted into said fire chamber, said air intake system including an air intake pipe connected to said base, a draft duct fluidly connected to said air intake pipe, a draft box mounted on said base to be located in said fire chamber and fluidly connected to said air duct to receive air therefrom, said draft box having openings defined therein to introduce air into said fire chamber, a draft plate located between said draft box and said air duct, said draft plate being slidably mounted on said frame to prevent and permit a flow of air into said draft box from said air duct to control the amount of air introduced into said draft box and thereby control the amount of air introduced into said fire chamber;

a viewing door on said frame for covering said fire chamber access opening, said door including supporting means for slidably receiving a spark screen, a viewing window, and a heat shield; and an exhaust system on said frame for exhausting air from said fire chamber.

2. The fireplace stove of claim 1 wherein said base includes support legs for supporting the stove above a supporting surface.

3. The fireplace stove of claim 2 wherein said air intake pipe is located beneath said stove.

4. The fireplace stove of claim 3 further including a grate assembly resting on said base in said fire chamber.

5. The fireplace stove of claim 1 wherein said draft duct is fluidly connected at one end thereof to said air intake pipe.

6. The fireplace stove of claim 1 wherein said draft plate is located at the connection of said draft box and said air duct.

7. A fireplace stove of claim 6 further including a fire liner on said base and one which said grate rests.

8. The fireplace stove of claim 6 wherein said draft box openings are positioned to introduce air near the bottom of said fire chamber and beneath said grate mechanism.

9. The fireplace stove of claim 6 further including draft plate guides on said base adjacent said draft box-air duct connection for guiding movement of said draft plate.

10. The fireplace stove of claim 1 further including a heat reflecting fire shield-plate mounted on said frame in said fire chamber.

11. The fireplace stove of claim 10 wherein said fire shield-plate is tilted.

12. The fireplace stove of claim 1 wherein said supporting means includes spaced guide rails mounted on said door to define channels for slidably receiving said spark screen, said viewing window, and said heat shield.

13. The fireplace stove of claim 12 wherein said heat shield is a single unitary plate and includes a handle on one edge thereof for grasping said heat shield to slidably move same in said guide rails.

14. The fireplace stove of claim 13 further including fire shield storage means on said frame for accommodating said unitary heat shield when said unitary heat shield is not in place in said door.

15. The fireplace stove of claim 1 further including a latching mechanism on said door and a latch plate on said frame adjacent said door, said latch plate being located in said fire chamber and having a scalloped edge, and said latching mechanism including a turn bolt rotatably mounted on said door, said turn bolt including a latch plate engaging lock bar which engages said scalloped edge for locking said door closed.

16. The fireplace stove of claim 15 wherein said scalloped edge is slanted so that said latching mechanism is closed more tightly when said turn bolt latching engaging lock bar is engaged against one portion of said scalloped edge than said latching mechanism is when said engaging lock bar is engaged against another portion of said scalloped edge.

17. The fireplace stove of claim 1 further including log roll bars secured on said door to intercept any logs which might roll out of said fire chamber before those logs move out of the stove.

18. The fireplace stove of claim 16 wherein said turn bolt further includes a hand grip portion located outside of said stove, said hand grip portion including helical coils for dissipating heat so that said handle grip portion remains tactile when there is a fire in said fire chamber.

19. The fireplace stove of claim 6 wherein said air duct is located in heat transfer connection with said fire chamber to transfer heat from said fire chamber to the air flowing in said air duct thereby pre-heating that air prior to introduction thereof into said fire chamber.

20. The fireplace stove of claim 6 further including a baffle plate mounted on said draft box so that air exhausted from said draft box impinges against said baffle during the introduction thereof into said fire chamber.

* * * * *